US011435129B2

(12) United States Patent
Yeom

(10) Patent No.: US 11,435,129 B2
(45) Date of Patent: Sep. 6, 2022

(54) REFRIGERATOR

(71) Applicant: LG Electronics Inc., Seoul (KR)

(72) Inventor: Taejin Yeom, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 17/057,447

(22) PCT Filed: Apr. 22, 2020

(86) PCT No.: PCT/KR2020/005305
§ 371 (c)(1),
(2) Date: Nov. 20, 2020

(87) PCT Pub. No.: WO2020/218817
PCT Pub. Date: Oct. 29, 2020

(65) Prior Publication Data

US 2021/0364221 A1 Nov. 25, 2021

(30) Foreign Application Priority Data

Apr. 26, 2019 (KR) ..... 10-2019-0049390

(51) Int. Cl.
*F25D 23/00* (2006.01)
*F25D 23/02* (2006.01)
*E05B 63/00* (2006.01)

(52) U.S. Cl.
CPC ..... *F25D 23/028* (2013.01); *E05B 63/0017* (2013.01); *F25D 23/025* (2013.01); (Continued)

(58) Field of Classification Search
CPC ..... F25D 23/028; F25D 23/025; F25D 2323/023; F25D 2323/024; F25D 11/02; (Continued)

(56) References Cited

U.S. PATENT DOCUMENTS 3,664,699 A * 5/1972 Weiselt ..... E05C 19/16 292/251.5
2013/0049562 A1* 2/2013 Jung ..... F25D 23/028 312/405

(Continued)

FOREIGN PATENT DOCUMENTS

CN 111256420 * 6/2020
EP 2990745 * 3/2016

(Continued)

OTHER PUBLICATIONS

PCT International Search Report in International Appln. No. PCT/KR2020/005305, dated Jul. 21, 2020, 4 pages (with English translation).

*Primary Examiner* — Janet M Wilkens
(74) *Attorney, Agent, or Firm* — Fish & Richardson P.C.

(57) ABSTRACT

Provided is a refrigerator including a body including a storage space; and a door configured to open or close the storage space, wherein the door includes a first door rotatably connected to the body by a hinge; a second door provided to be rotatable with respect to the first door; a magnetic member provided at the body; and a locking device provided at the first door and configured to interact with the magnetic member, wherein the first door and the second door are unlocked in a state where the first door is closed, and the first door and the second door are locked in a state where the first door is opened.

20 Claims, 14 Drawing Sheets

(52) U.S. Cl.
CPC ..... *E05Y 2900/31* (2013.01); *F25D 2323/023* (2013.01); *F25D 2323/024* (2013.01)

(58) Field of Classification Search
CPC ..... E05B 63/0017; E05B 47/0038; E05Y 2900/31; E05C 19/163; E05C 19/161; E05C 7/02
USPC ..... 312/401, 405
See application file for complete search history.

(56) References Cited

U.S. PATENT DOCUMENTS

| | | | | |
|---|---|---|---|---|
| 2014/0232251 | A1* | 8/2014 | Kim | F25D 23/025 312/405 |
| 2015/0137674 | A1* | 5/2015 | Choi | F25D 23/062 312/405 |
| 2016/0201976 | A1 | 7/2016 | Choi et al. | |
| 2017/0176086 | A1* | 6/2017 | Kang | F25D 11/02 |
| 2019/0032990 | A1* | 1/2019 | Wantland | E05C 7/02 |
| 2021/0079689 | A1* | 3/2021 | Marsden | E05B 65/46 |

FOREIGN PATENT DOCUMENTS

| | | | |
|---|---|---|---|
| KR | 20140046207 | * | 4/2014 |
| KR | 1020150029083 | | 3/2015 |
| KR | 20150098915 | * | 8/2015 |
| KR | 1020170031489 | | 3/2017 |
| KR | 1020170072750 | | 6/2017 |
| KR | 20170081553 | * | 7/2017 |
| KR | 1020170119923 | | 10/2017 |

* cited by examiner

REFRIGERATOR

CROSS-REFERENCE TO RELATED APPLICATIONS

This application is a National Stage application under 35 U.S.C. § 371 of International Application No. PCT/KR2020/005305, filed on Apr. 22, 2020, which claims the benefit of Korean Patent Application No. 10-2019-0049390, filed on Apr. 26, 2019. The disclosures of the prior applications are incorporated by reference in their entirety.

TECHNICAL FIELD

The present disclosure relates to a refrigerator.

BACKGROUND ART

In general, a refrigerator is a device for freezing or refrigerating food or the like by discharging cold air generated by a refrigeration cycle including a compressor, a condenser, an expansion valve, and an evaporator to a storage space to lower a temperature of the storage space.

The refrigerator may include a freezing space for freezing and storing food or beverage and a refrigerating space for storing food or beverage at a low temperature, as storage spaces.

The refrigerator may be classified into a top mount type in which the freezing space is located at the top of the refrigerating space, a bottom freezing space type in which the freezing space is located at the bottom of the refrigerating space, and a side-by-side type in which the freezing space and the refrigerating space are divided into left/right sides.

Such a refrigerator may include doors that open and close each of the freezing space and the refrigerating space, and thus the freezing space or the refrigerating space may be accessed through each door.

Recently, a refrigerator in such a form that only a portion of the storage space is opened is provided. That is, a refrigerator having a sub-door is provided to open and close a sub-storage space provided in a main door. The sub-storage space is a partial area of a main storage space and is at least partially partitioned from the main storage space by a partition.

For example, storage materials such as beverages that are frequently used may be stored in the sub-storage space, and the sub-storage space may be accessed by opening the sub-door, without opening the main door.

A refrigerator having a dual door is disclosed in Korean Patent Laid-Open No. 10-2017-0072750, which is a related art document.

The refrigerator of the related art document includes a body having a storage space, a first door rotatably provided on the body to open and close the storage space, a door frame provided in the first door, a side wall part rotatably provided in the first door and having at least a portion inserted into an opening of the door frame, a second door having an engaging part provided at the side wall part, a magnetic member provided in the body, and a locking device selectively allowing rotation of the second door with respect to the first door The locking device includes a movable member including a magnetic member corresponding to the magnetic member of the main body and having a different placement due to a change in a magnetic force as a distance to the magnetic member of the body is changed according to an opening or closing state of the first door and an engaging member having a displacement in which a protrusion length in the door frame is varied according to displacement of the movable member and selectively restrained by the engaging part.

According to the related art document, since the movable member moves in a horizontal direction in the process of opening the first door, a space for horizontal movement of the movable member in the first door must be secured, having a disadvantage in that it is difficult to design for interference prevention.

In addition, the locking member is disposed so that the movable member penetrates, and since the locking member is located at an inclined part of the movable member, the locking member may move in the up-down direction while the movable member moves in the horizontal direction.

However, when the movable member moves in the horizontal direction, a direction is changed by the inclined part, so a vertical movement length of the locking member based on a unit movement path of the movable member is short, having a disadvantage in that a movement length of the movable member should be increased to secure the vertical movement length of the locking member.

According to the related art document, since the locking member is moved up and down by the inclined part of the movable member, a height of the movable member is increased by the inclined part, thereby increasing a size of the locking device.

In addition, according to the related art document, since the movable member is arranged to move in the horizontal direction, an elastic member is additionally provided to move the movable member in the horizontal direction when the first door is opened, thereby complicating a structure of the locking device.

In addition, according to the related art document, since the movable member moves in the horizontal direction in a state where the inclined part of the movable member and the locking member are in line or surface contact and the locking member moves up and down, a friction force acts between the locking member and the movable member, and thus the movement of the movable member and the locking member is not smooth and the movable member and/or the locking member may be damaged by continuous friction.

DISCLOSURE

Technical Problem

An aspect of the present disclosure provides a refrigerator in which damage to a locking device is prevented even when the locking device is repeatedly operated.

Another aspect of the present disclosure provides a refrigerator in which a movable member and a locking member may operate smoothly, while the locking device becomes compact.

Another aspect of the present disclosure provides a refrigerator in which noise that occurs when a switch is pressed during a button operation process is minimized.

Another aspect of the present disclosure provides a refrigerator in which a locking member may be lowered by its own weight in a process of opening a first door without an additional external force.

Another aspect of the present disclosure provides a refrigerator in which a locking device may be operated from an unlocked state to a locked state quickly at an initial stage of opening of a first door.

Another aspect of the present disclosure provides a refrigerator in which a foaming liquid for forming an insulating material in a first door is prevented from leaking through a through hole providing a passage of a locking member.

Technical Solution

In one aspect of the present disclosure, there is provided a refrigerator including a locking device configured to perform locking or unlocking between a second door rotatable with respect to a first door for opening and closing a storage space and the first door.

The locking device may cause the first door and the second door to be unlocked in a state where the first door is closed and cause the first door and the second door to be locked in a state where the first door is opened.

The locking device may include a movable member configured to perform a rotational operation and a locking member rotatably connected to the movable member, so that friction with the locking member may be minimized during rotation of the movable member, thereby preventing damage to components.

The movable member may include a rotary shaft for a rotational operation, and the locking member may be connected to the movable member on the opposite side of the rotary shaft in a longitudinal direction of the movable member, so that a moving distance of the locking member per unit rotation angle of the movable member may be increased.

The refrigerator may include a magnetic member provided in a body having a storage space, and the movable member may be rotated by interaction with the magnetic member.

As an example, the movable member may include a core body that interacts with the magnetic member. As the core body is located higher than the rotary shaft and a connection part of the movable member is located as far as possible from the rotary shaft, the movable member may be smoothly rotated in the process of opening the first door, and accordingly, the locking member may be smoothly lowered.

The locking device may be located on the opposite side of a hinge for rotation of the first door in the first door, so that the locking device may be quickly operated from an unlocked state to a locked state at the initial opening of the first door.

The first door may include an inner frame and an outer frame, and the locking device may be seated and fixed to the inner frame.

The locking device may further include a housing accommodating the movable member and the locking member.

The housing may include: a first bottom wall located below the rotary shaft; and a second bottom wall extending to be downwardly inclined from the first bottom wall, so that interference between the second bottom wall and the movable member may be prevented in the process of rotating the movable member.

The movable member may include: a movable body having the rotary shaft; an extending part extending from the movable body in a direction away from the magnetic member; and a first connection part extending from the extending part and connected to the locking member.

The locking member may include a second connection part connected to the first connection part.

Vertical and horizontal widths of the extending part may be smaller than vertical and horizontal widths of the movable body. The extending part may extend from a position higher than the rotary shaft.

The first connection part may include a coupling slot, and the second connection part may include a coupling protrusion accommodated in the coupling slot.

The coupling slot may elongate in a longitudinal direction of the movable member.

The housing may be fixed to the inner frame and include a first opening allowing the locking member to pass therethrough, and the inner frame may have a through hole aligned with the first opening.

The housing may be seated in the inner frame and disposed to surround the through hole.

The inner frame may include a coupling boss, and the housing may include a boss accommodation part configured to accommodate the coupling boss. A screw may be fastened to the coupling boss through a portion of the boss accommodation part in a state where the coupling boss is accommodated in the boss accommodation part.

The inner frame may include a plurality of coupling bosses to be fastened to the housing. The through hole may be located between the plurality of coupling bosses, and a portion of the housing may be located between the plurality of coupling bosses.

The inner frame may further include an edge portion, and the edge portion may have a first fixing part. The housing may include a second fixing part fixed to the first fixing part when the housing is seated in the inner frame.

The housing may further include a second opening exposing the movable body to outside of the housing. The second opening may be disposed to face the magnetic member in a state where the first door is closed.

The cabinet may further include a hinge cover covering the hinge, and the magnetic member may be installed at the hinge cover.

In another aspect of the present disclosure, there is provided a refrigerator including: a body having a storage space; and a door configured to open or close the storage space.

The door may include: a first door rotatably connected to the body by a hinge; a second door provided to be rotatable with respect to the first door; a magnetic member provided at the body; and a locking device provided at the first door and configured to interact with the magnetic member and to cause the first door and the second door to be unlocked in a state where the first door is closed and to cause the first door and the second door to be locked in a state where the first door is opened.

The locking device may include: a housing; a movable member installed to be rotatable by a rotary shaft and configured to rotate in a first direction by an attraction with the magnetic member and to rotate in a second direction when the attraction with the magnetic member is removed; and a locking member rotatably connected to the movable member and configured to be accommodated in a locking recess of the second door through the first door when the movable member rotates in the second direction.

The rotary shaft may be located adjacent to a first end portion of the movable member, and the locking member may be connected to a second end portion which is the opposite to the first end portion in a longitudinal direction of the movable member.

For example, the movable member may be formed of a metal material interacting with the magnetic member.

Alternatively, the movable member may include a core body configured to interact with the magnetic member. The core body may be located higher than the rotary shaft so that the movable member in which the core body is accommodated may be easily rotated by its own weight in the process of opening the first door.

The movable member may include a first surface disposed to face the magnetic member in a state where the first door is closed and a second surface which is the opposite to the first surface.

The core body may be located closer to the first surface than to the second surface.

The core body may be in contact with the first surface and spaced apart from the second surface.

The movable member may include a lower surface connecting lower portions of the first surface and the second surface and an upper surface connecting upper portions of the first surface and the second surface.

The core body may be located closer to the upper surface than to the lower surface of the movable member.

The core body may be in contact with the upper surface and spaced apart from the lower surface, and the movable member may include a support lib configured to support the core body spaced apart from the lower surface.

Advantageous Effects

According to the proposed embodiment, since the movable member rotates and the locking member is rotatably connected to the movable member, damage due to friction between the movable member and the locking member may be prevented and the movable member and the locking member may operate smoothly.

In addition, since the connection part of the movable member is located as far as possible from the hinge, the vertical movement distance of the locking member per unit angle of the movable member is increased, so that the length of the movable member or the locking member may be reduced, thereby making the locking device compact.

In addition, according to the present embodiment, since the button part is formed of a flexible material and the pressing part of the button part presses the switch, noise that may occur when the switch is pressed during the button operation process may be minimized.

In addition, since the core body accommodated in the movable member is located higher than the rotary shaft and the connection part of the movable member is located as far as possible from the rotary shaft, the movable member rotates smoothly in the process of opening the first door, and accordingly, the locking member may be smoothly lowered and accommodated in the locking recess.

In addition, since the locking device is located on the opposite side of the hinge of the first door, the locking device may be quickly operated from the unlocked state to the locked state at the initial opening of the first door.

In addition, since the locking device is disposed to surround the through hole of the inner frame, a foaming liquid may be prevented from being exposed to the outside through the through hole.

In addition, since the coupling boss for coupling the locking device is located around the through hole of the inner frame, the foaming liquid may be prevented from flowing toward the through hole by the coupling boss.

MODE FOR INVENTION

Figure 1:
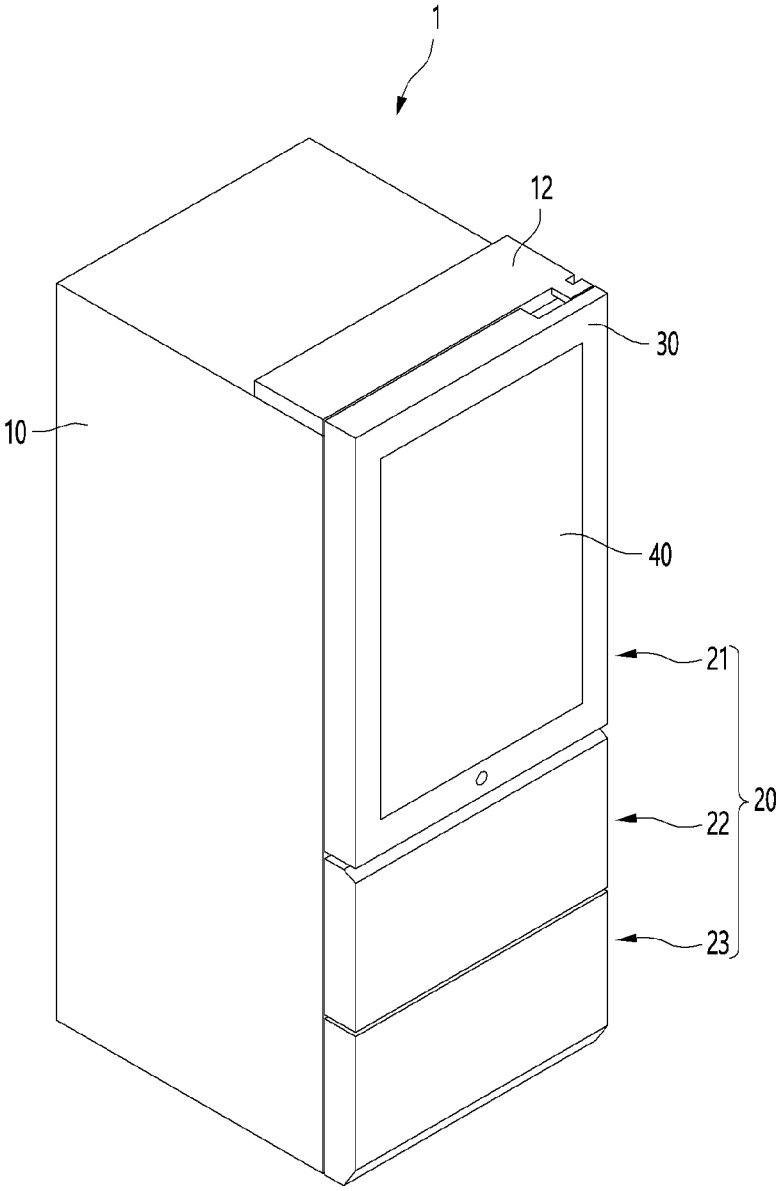
FIG. 1 is a perspective view of a refrigerator according to an embodiment of the present disclosure.

Hereinafter, some embodiments of the present disclosure will be described in detail with reference to the accompanying drawings. It should be noted that when components in the drawings are designated by reference numerals, the same components have the same reference numerals as far as possible even though the components are illustrated in different drawings. Further, in description of embodiments of the present disclosure, when it is determined that detailed descriptions of well-known configurations or functions disturb understanding of the embodiments of the present disclosure, the detailed descriptions will be omitted.

Also, in the description of the embodiments of the present disclosure, the terms such as first, second, A, B, (a) and (b) may be used. Each of the terms is merely used to distinguish the corresponding component from other components, and does not delimit an essence, an order or a sequence of the corresponding component. It should be understood that when one component is "connected", "coupled" or "joined" to another component, the former may be directly connected or jointed to the latter or may be "connected", coupled" or "joined" to the latter with a third component interposed therebetween.

Figure 2:
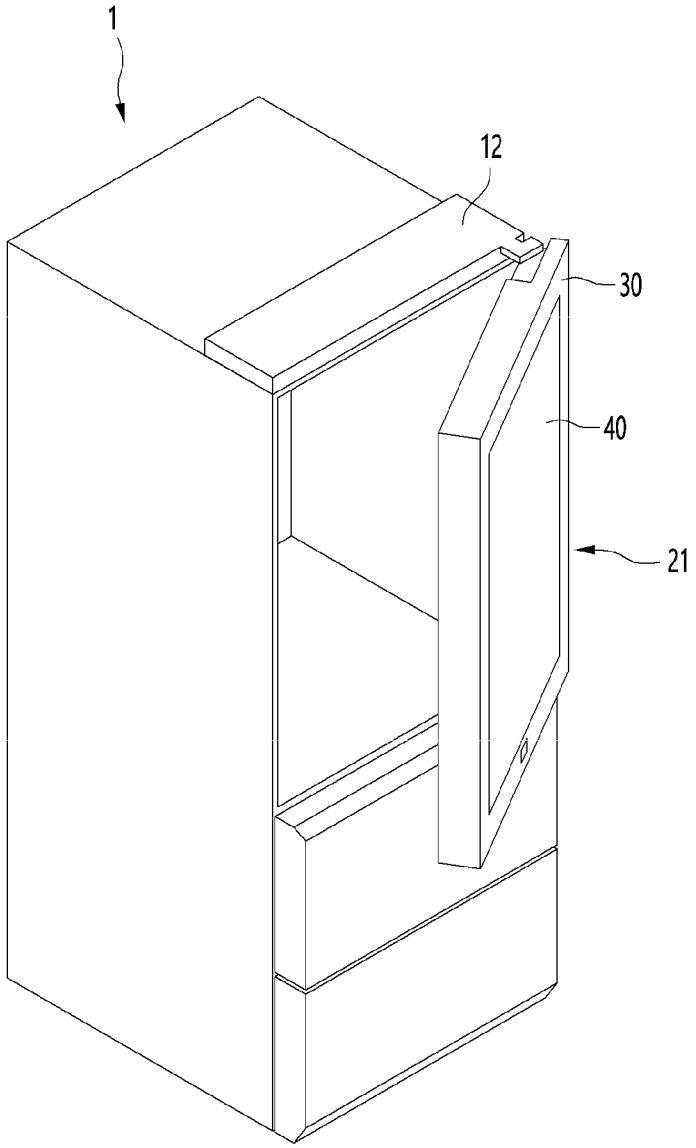
FIG. 2 is a view showing a state where a first door and a second door are opened together according to an embodiment of the present disclosure.
Figure 3:
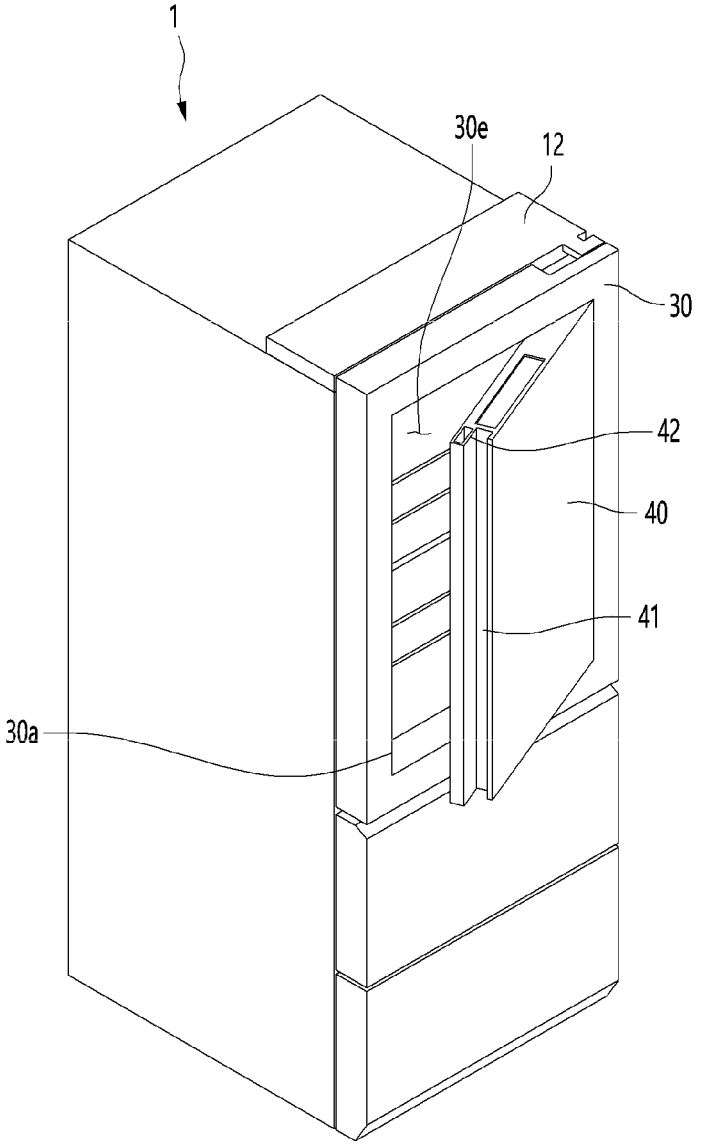
FIG. 3 is a view showing a state where a second door is opened while a first door is closed according to an embodiment of the present disclosure.
Figure 4:
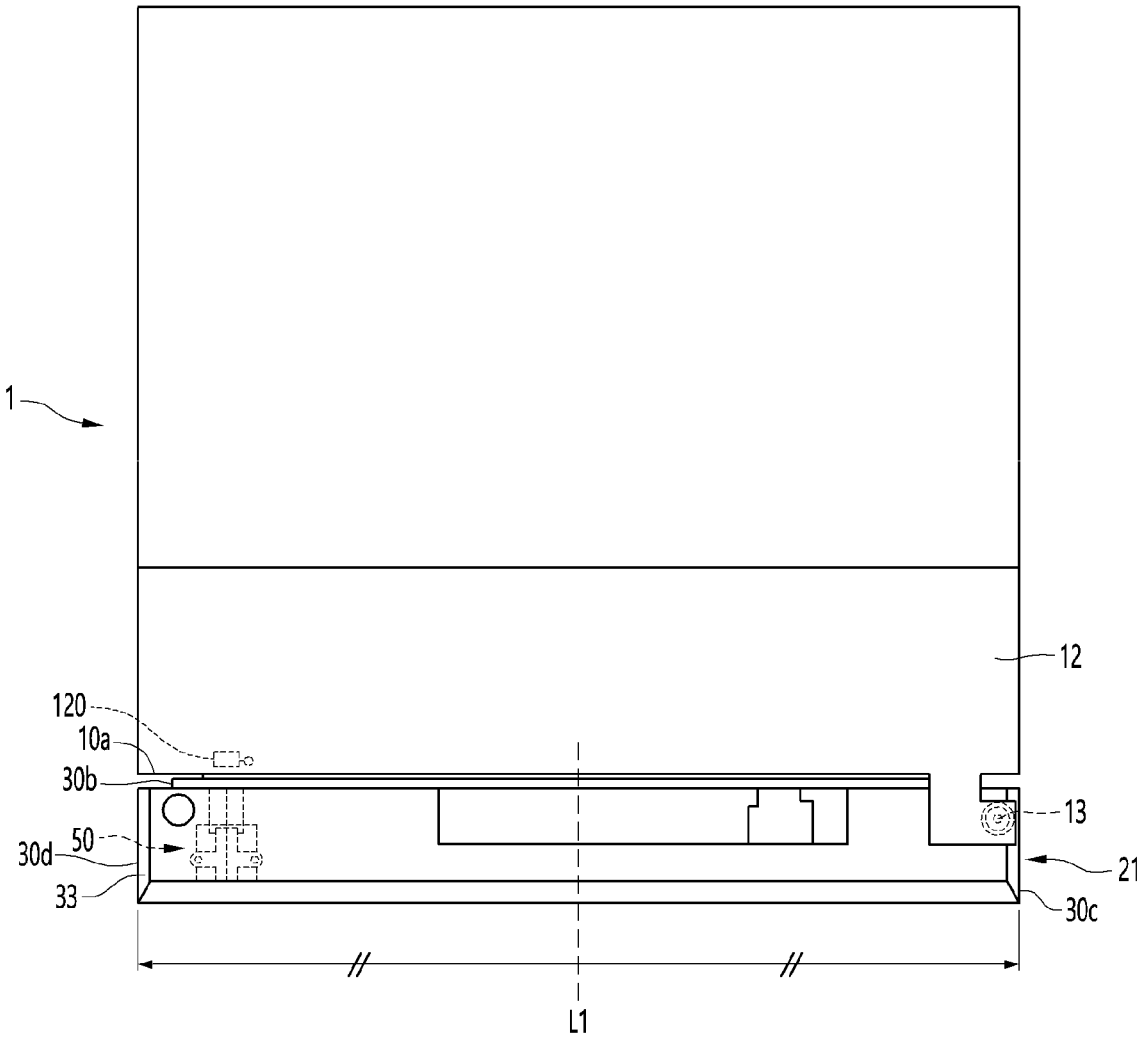
FIG. 4 is a plan view of a refrigerator according to an embodiment of the present disclosure.

FIG. 1 is a perspective view of a refrigerator according to an embodiment of the present disclosure, FIG. 2 is a view showing a state where a first door and a second door are opened together, and FIG. 3 is a view showing a state where the second door is opened while the first door is closed according to an embodiment. FIG. 4 is a plan view of a refrigerator according to an embodiment of the present disclosure.

Referring to FIGS. 1 to 4, the refrigerator 1 according to the present embodiment may include a cabinet 10 having a storage space and a door 20 connected to the cabinet 10 to open and close the storage space.

The storage space may be divided into a plurality of storage spaces, and a plurality of doors 20 may open and close the plurality of storage spaces.

For example, the plurality of doors 20 may include a first storage space door 21 that rotates and one or more second storage space doors 22 and 23 that slide. However, it should be noted that there is no limit to the operation method of the plurality of doors 20 in this embodiment.

In FIG. 1, for example, the first storage space door 21 is located above, and the second and third storage space doors 22 and 23 are located at the lower side of the first storage space door 21.

The first storage space door 21 may open/close a refrigerating space, for example. The refrigerating space may store food at a temperature above zero.

Meanwhile, the second and third storage space doors 22 and 23 may open and close the freezing space, for example. The freezing space may store food at sub-zero temperatures.

Of course, the first storage space door 21 may open and close the freezing space, and the refrigerator may include only the first storage space door 21.

Hereinafter, the first storage space door 21 that may be rotated will be described.

The first storage space door 21 includes a first door 30 rotatably connected to the cabinet 10 by a hinge 13 and a second door 40 rotatably connected to the first door 30.

The first door 30 may include an opening 30*a*, and the second door 40 may open and close the opening 30*a*.

The first door 30 may include a door storage space 30*e*. The door storage space 30*e* may be formed by a separate frame coupled to the first door 30 or may be formed by a door basket.

When the second door 40 is opened while the first door 30 is closed, the door storage space 30*e* may be accessed through the opening 30*a*.

In this embodiment, the refrigerator 1 may further include a locking device 50 allowing the second door 40 to rotate with respect to the first door 30 when the first door 30 is closed and restricting rotation of the second door 40 with respect to the first door 30 in a state where the first door 30 is opened.

Therefore, when the first door 30 is closed, the second door 40 may be opened, and when the first door 30 is opened, opening of the second door 40 may be prevented.

The second door 40 may include a handle 41, and when the first door 30 is closed, the second door 40 may be opened by gripping the handle 41.

In this embodiment, a state where the second door 40 may be rotated with respect to the first door 30 may be referred to as an unlocked state, and a state where rotation of the second door 40 with respect to the first door 30 is restricted may be referred to as a locked state.

The locking device 50 may be provided at the first door 30. The locking device 50 provided at the first door 30 may be operated by magnetic force even when it is not exposed to the outside.

The cabinet 10 may include a magnetic member 120 that interacts with the locking device 50.

For example, the magnetic member 120 may be a magnet. The magnetic member 120 may be located inside the cabinet 10 and close to a front surface 10*a* of the cabinet 10.

The magnetic member 120 may be disposed so as to face the locking device 50 from the cabinet 10.

Alternatively, the cabinet 10 may include a hinge cover 12 covering the hinge 13, and the magnetic member 120 may be installed on the hinge cover 12 from the outside of the cabinet 10. The hinge cover 12 may cover the hinge 13 from an upper side of the cabinet 10, for example. The magnetic member 120 in the hinge cover 12 may be disposed to face the locking device 50.

In any case, the magnetic member 120 may be disposed as close as possible to the locking device 50 without being exposed to the outside of the refrigerator 1.

The first door 30 is provided with a gasket 30*b* in which a magnet is accommodated, and when the first door 30 is closed, the gasket 30*b* is in contact with the front surface 10*a* of the cabinet 10. Here, a state where the gasket 30*b* is in contact with the front surface 10*a* of the cabinet 10 is maintained by the magnet.

The locking device 50 operates in a first state (unlocked state of the first door and the second door) by magnetic force, and when the magnetic force is removed, the locking device 50 may operate in a second state (locked state of the first door and the second door).

For example, when the first door 30 is closed, the locking device 50 may be brought into the first state by magnetic force by the magnetic member 120.

During the opening of the first door 30, the magnetic force of the magnetic member 120 may be removed so that the locking device 50 may enter the second state.

In the present embodiment, the locking device 50 may be located on the opposite side of the hinge 13 based on a line L1 bisecting a horizontal length of the first door 30.

In the process of opening the first door 30, an interval between the first door 30 and the cabinet 10 increases in a direction away from the hinge 13.

Since the locking device 50 is provided at the first door 30 and the magnetic member 120 is provided at the cabinet 10, the locking device 50 is preferably located as far as possible from the hinge 13 so that the locking device 50 may operate in the second state.

That is, the locking device 50 should be located as far as possible from the hinge 13, so that the magnetic force of the magnetic member 120 may be quickly removed at the initial opening of the first door 30 and the locking device 50 may be quickly operated to change from the first state to the second state.

As an example, the first door 30 may include a first side surface 30*c* adjacent to the hinge 13 and a second side surface 30*d* facing the first side surface 30*c* and located opposite the first side surface 30*c*.

The locking device 50 may be located closer to the second side surface 30*d* than the bisector line L1.

Since the magnetic member 120 is located on an upper side of the cabinet 10, the locking device 50 may be located at an upper portion of the first door to interact with the magnetic member 120.

A portion or the entirety of the second door 40 may be accommodated in the opening 30*a* of the first door 30, for example. In this case, the locking device 50 may be located higher than at least a portion of the second door 40.

In order to lock the first door 30 and the second door 40 by the locking device 50, the upper surface of the portion accommodated in the opening 30*a* of the second door 40 may have a locking recess 42 for accommodating a portion of the locking device 50.

When the entirety of the second door 40 is accommodated in the opening 30*a* of the first door 30, the locking device 50 may be located higher than the upper surface of the second door 40 and the locking recess 42 may be provided on an upper surface of the second door 40.

When the locking recess 42 is located on the upper surface of the second door 40, even if the second door 40 is opened, the locking recess 42 is not exposed to the user.

Hereinafter, the locking device 50 will be described in detail.

Figure 5:
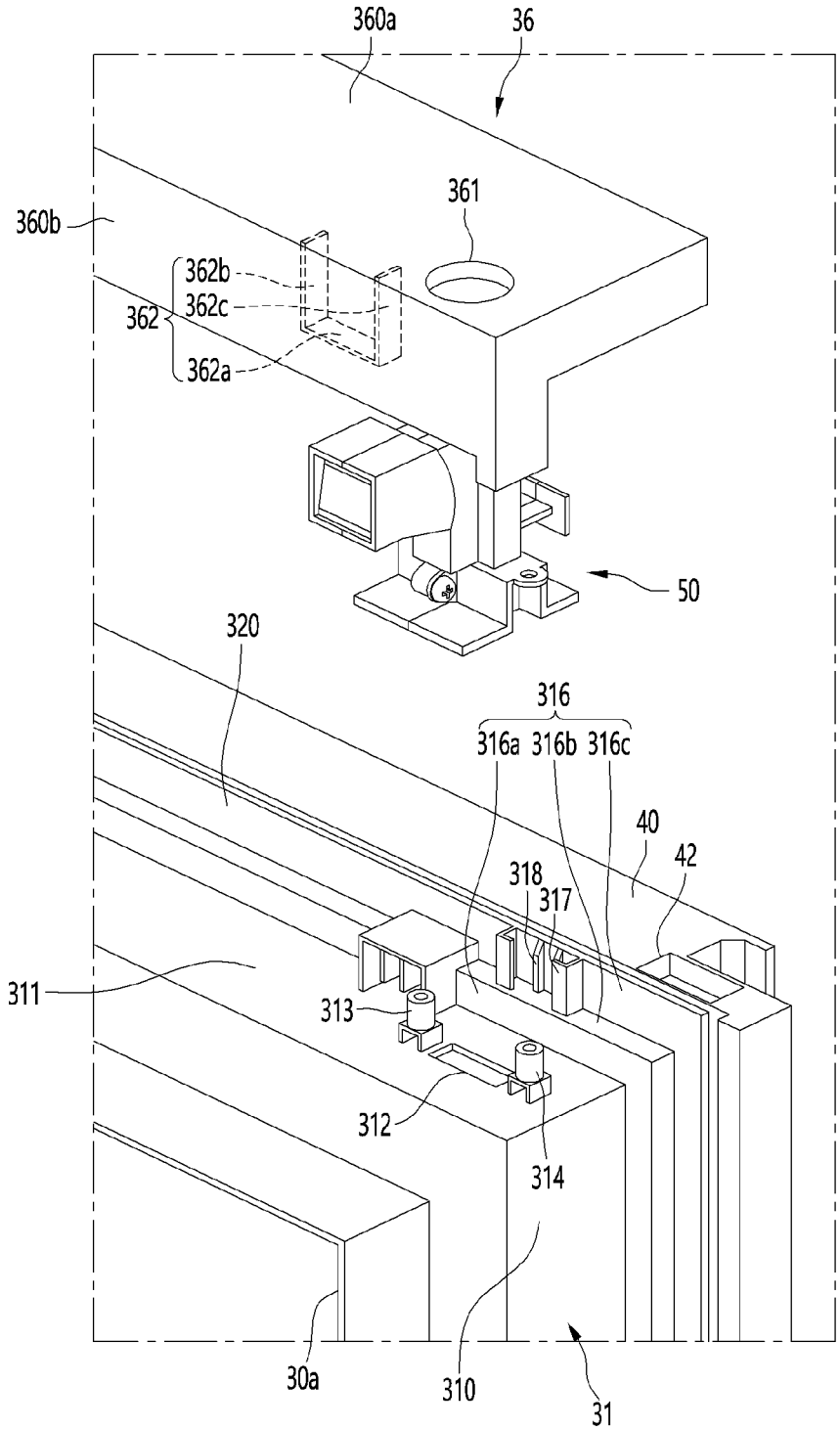
FIG. 5 is an exploded perspective view of a first door according to an embodiment of the present disclosure.
Figure 6:
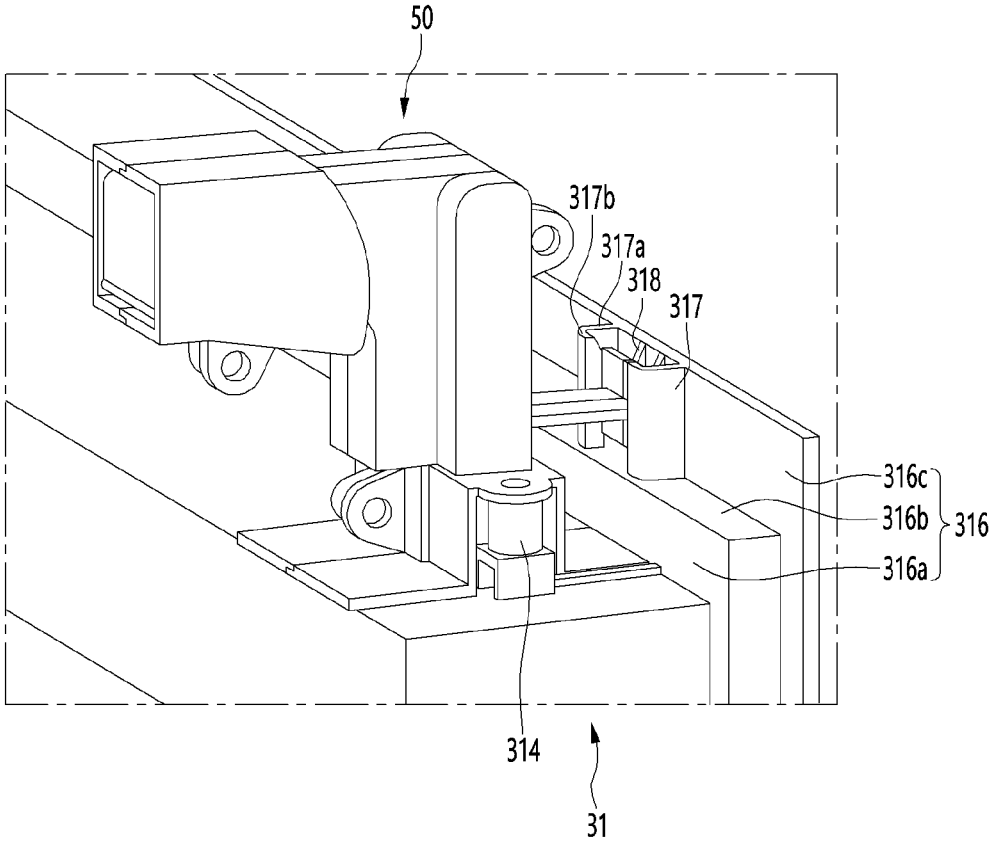
FIG. 6 is a view showing a state where a locking device is installed on an inner frame of a first door.

FIG. 5 is an exploded perspective view of a first door according to an embodiment of the present disclosure, and FIG. 6 is a view showing a state where a locking device is installed at an inner frame of the first door.

Referring to FIGS. 5 and 6, the first door 30 may include an inner frame 31 defining an opening 30*a*.

The inner frame 31 may be formed in a rectangular frame shape. The locking device 50 may be fixed to the inner frame 31.

As an example, the inner frame 31 may include a pair of side surface portions 310 and an upper surface portion 311 connecting upper sides of the pair of side surface portions 310. The locking device 50 may be seated on the upper surface portion 311.

The upper surface portion 311 of the inner frame 31 may include coupling bosses 313 and 314 for coupling the locking device 50. For stable coupling of the locking device 50, a plurality of coupling bosses 313 and 314 may be disposed to be spaced apart from each other on the upper surface portion 311. The plurality of coupling bosses 313 and 314 may be spaced apart from each other in a left-right direction, for example.

The plurality of coupling bosses 313 and 314 may protrude upward from the upper surface portion 311 of the inner frame 31.

The locking device 50 may accommodate the plurality of coupling bosses 313 and 314, and in this state, the locking device 50 may be fastened to the plurality of coupling bosses 313 and 314 by a fastening member (not shown).

For example, the locking device 50 may be seated on the upper surface portion 311 while moving from an upper side to a lower side of the upper surface portion 311. While the locking device 50 is seated on the upper surface portion 311, the plurality of coupling bosses 313 and 314 may be accommodated in the locking device 50.

The fastening member may be fastened to the plurality of coupling bosses 313 and 314 through a portion of the locking device 50 from above.

The inner frame 31 may further include an edge portion 316 extending along a circumference of the upper surface portion 311. The edge portion 316 may extend outward from a front end portion of the upper surface portion 311.

The edge portion 316 may be formed in a straight line or bent one or more times. FIG. 5 shows the edge portion 316 bent more than once, for example.

A first fixing part 317 for fixing the locking device 50 may be provided on the edge portion 316.

The first fixing part 317 guides movement of the locking device 50 while the locking device 50 is seated on the upper surface portion 311, and when the locking device 50 is seated on the upper surface portion 311, the first fixing part 317 restricts movement of the locking device 50.

For example, a pair of first fixing parts 317 may be disposed to be spaced apart from each other in a horizontal direction, and each of the first fixing parts 317 may be formed in a bent shape such as "L".

Each of the first fixing parts 317 may include a first portion 317*a* disposed to be spaced apart in the horizontal direction and a second portion 317*b* extending in a direction closer to each other from ends of the pair of first portions 317*a*.

A portion of the locking device 50 may be located between the pair of first fixing parts 317. The pair of first fixing parts 317 may be provided in the form of a rail to allow the locking device 50 to be slidably coupled thereto in the up-down direction.

The edge portion 316 includes a first extending part 316*a* extending in a substantially vertical direction from the upper surface portion 311, a second extending part 316*b* extending in the horizontal direction from the first extending part 316*a*, and a third extending part 316*c* extending in a substantially vertical direction from the second extending part 316*b*.

The pair of first fixing parts 317 may be connected to the second extending part 316*b* and the third extending part 316*c*. For example, the pair of fixing parts 317 may be integrally formed with the second extending part 316*b* and the third extending part 316*c*.

The first portion 317*a* may protrude from the third extending part 316*c*, and the second portion 317*b* may be substantially parallel to the third extending part 316*c*.

The second portions 317*b* of the first fixing parts 317 may be spaced apart from each other, and the second portions 317*b* may also be spaced apart from the third extending part 316*c*.

Accordingly, a portion of the locking device 50 may be accommodated between the second portion 317*b* and the third extending part 316*c*.

The edge portion 316 may further include a pressing rib 318 for pressing the locking device 50 fixed to the first fixing part 317.

The pressing rib 318 may protrude from the third extending part 316*c*, for example. An upper side of the pressing rib 318 may include an inclined surface 318*a* inclined in a direction away from the third extending part 316*c* downward.

During a manufacturing process, an error such as in a thickness and length of the locking device 50 and the first fixing part 317 may occur. When the pressing rib 318 is formed at the edge portion 316, the locking device 50 may be stably maintained in a state fixed to the first fixing part 317 even if an error occurs in the manufacturing process.

The first door 30 may further include an outer frame 36 disposed to surround the inner frame 31 on an outer side of the inner frame 31.

The outer frame 36 may be formed as a single frame or by coupling a plurality of frames.

The outer frame 36 may cover the locking device 50 fixed to the inner frame 31.

For example, an upper frame among the outer frames 36 may cover the locking device 50.

The outer frame 36 may have a position guide rib 362 for guiding a position of the locking device 50. The position guide rib 362 serves to determine a position of the locking device 50 with respect to the outer frame 36.

The outer frame 36 may include an upper surface portion 360*a* and a bent portion 360*b* bent and extending from the upper surface portion 360*a*.

As an example, the bent portion 360*b* may be disposed to face the front surface of the hinge cover 12 or the front surface 10*a* of the cabinet 10.

In addition, the bent portion 360*b* may be disposed to face the magnetic member 120.

The position guide rib 362 may be provided at the bent portion 360*b*. The position guide rib 362 may surround a portion of the locking device 50 where a movable member to be described later is located.

The position guide rib 362 may include, for example, a horizontal extending part 362*a* and a plurality of vertical extending parts 362*b* and 362*c* extending upward from both ends of the horizontal extending part 362*a*.

A portion of the locking device 50 may be located between the plurality of vertical extending parts 362*b* and 362*c*, and the horizontal extending part 326*a* may be located on a lower side of a portion of the locking device 50 where the movable member is located.

Upper ends of the vertical extending parts 362*b* and 362*c* may be in contact with a lower surface of the upper surface portion 360*a*.

The outer frame 36 may include a hole 361 for injecting a foaming liquid for forming an insulator into a space between the outer frame 36 and the inner frame 31.

The position guide rib 362 may surround a portion of the locking device 50 to serve to prevent the foaming liquid from entering the locking device 50. For example, the position guide rib 362 may surround a second opening (see 518 in FIG. 7) of the locking device 50.

Meanwhile, a through hole 312 through which a portion of the locking device 50 passes may be provided at the upper surface portion 311 of the inner frame 31 so that the locking device 50 enters a locked state.

The through hole 312 may be located between the plurality of coupling bosses 313 and 314, for example. The locking device 50 may surround the through hole 312, while seated on the upper surface portion 311 of the inner frame 31.

Therefore, according to the present embodiment, since a plurality of coupling bosses 313 and 314 are provided around the through hole 312, the plurality of coupling bosses 313 and 314 may restrict movement of foaming liquid toward the through hole 312.

In addition, since the locking device 50 surrounds the through hole 312, the foaming liquid may be prevented from leaking through the through hole 312.

Figure 7:
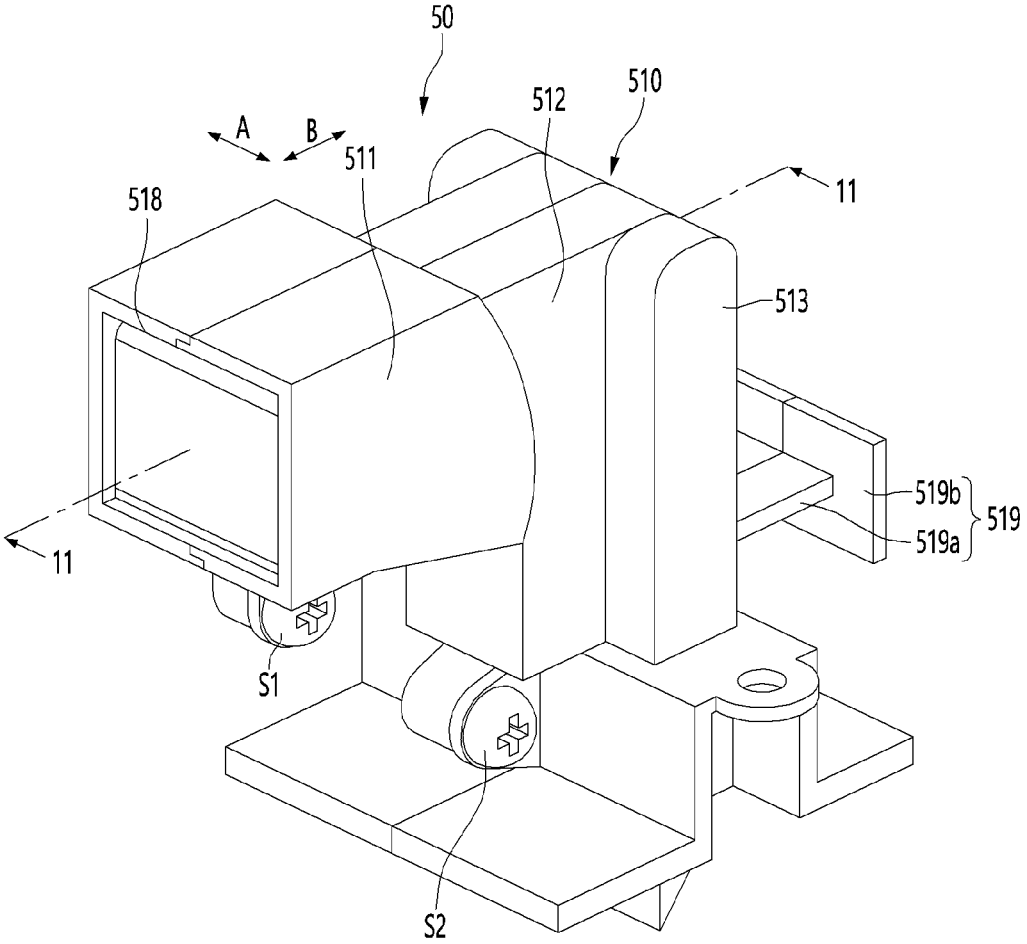
FIGS. 7 and 8 are perspective views of a locking device according to an embodiment of the present disclosure.
Figure 8:
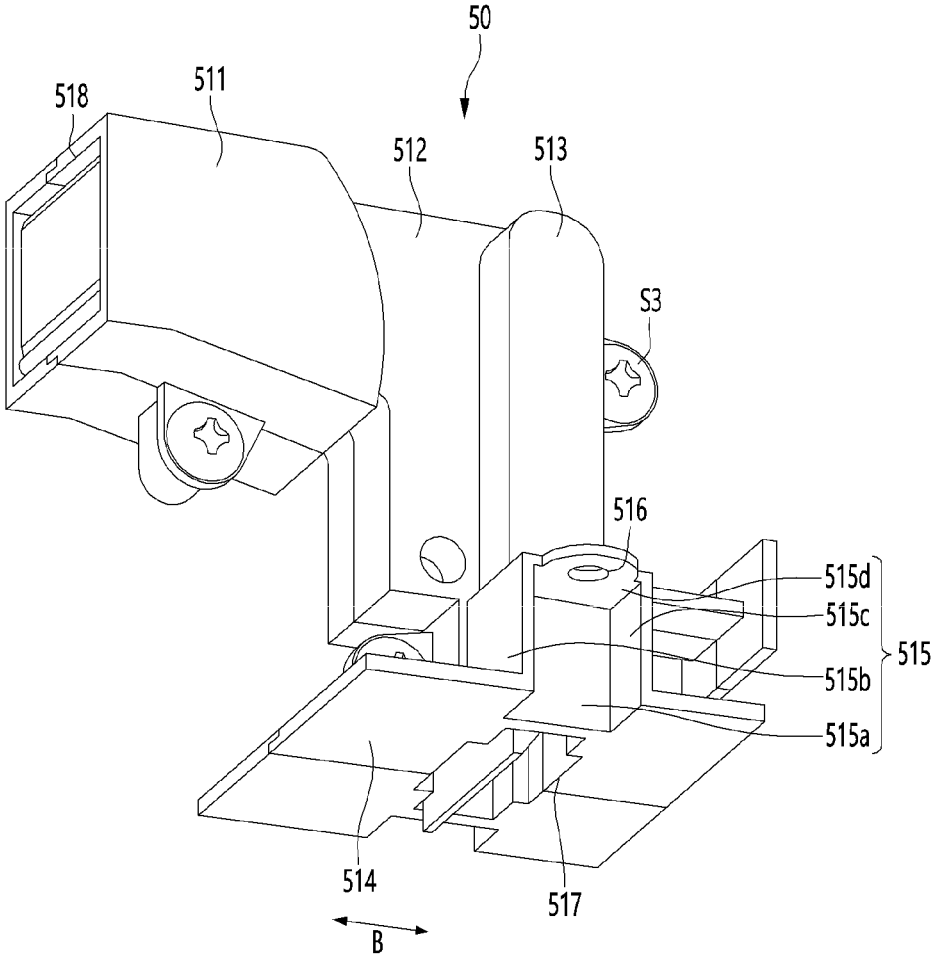
Figure 9:
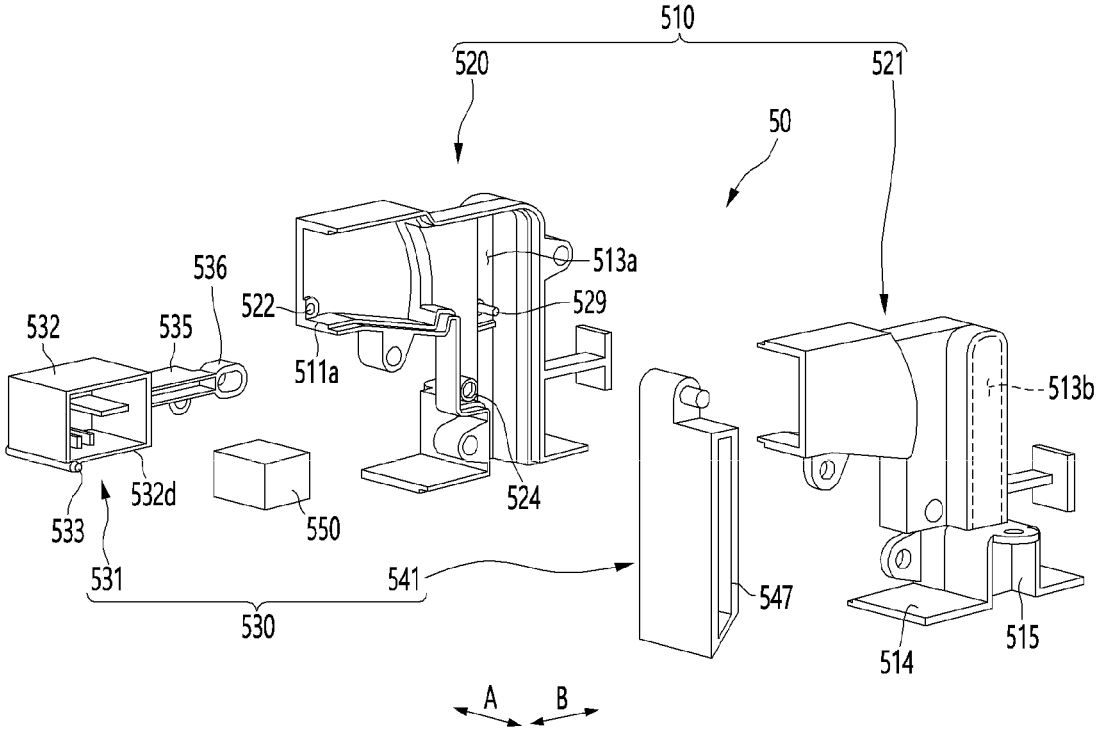
FIGS. 9 and 10 are exploded perspective views of a locking device according to an embodiment of the present disclosure.
Figure 10:
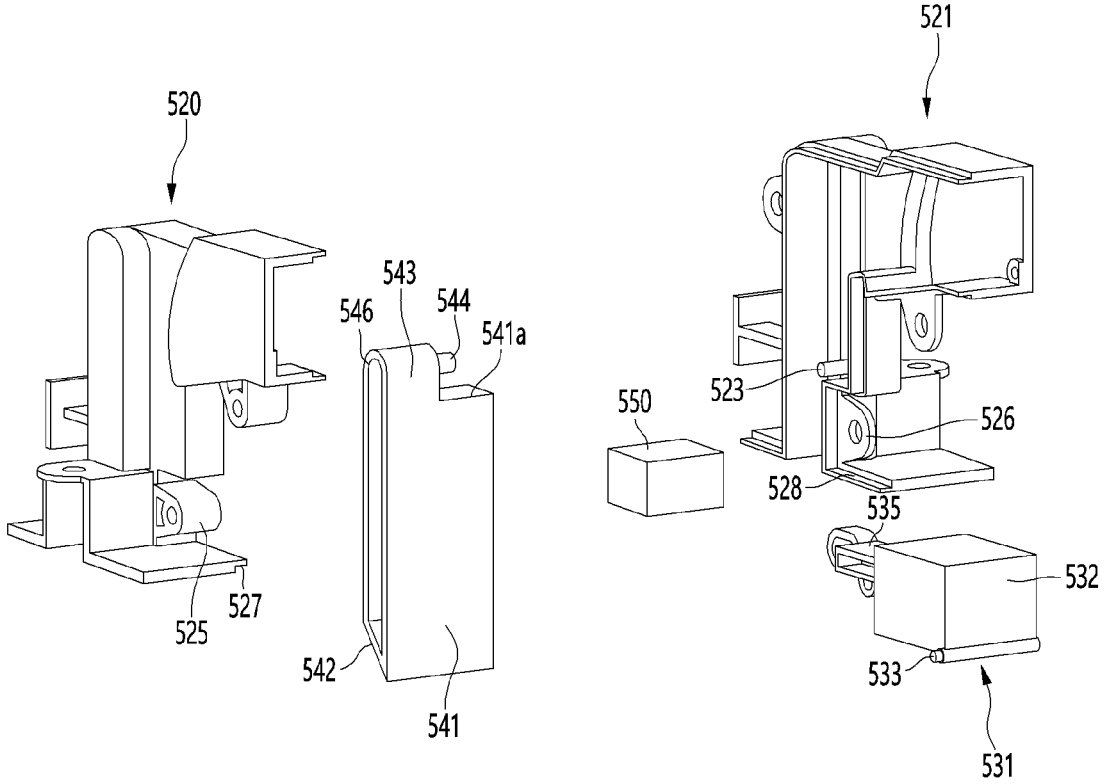
Figure 11:
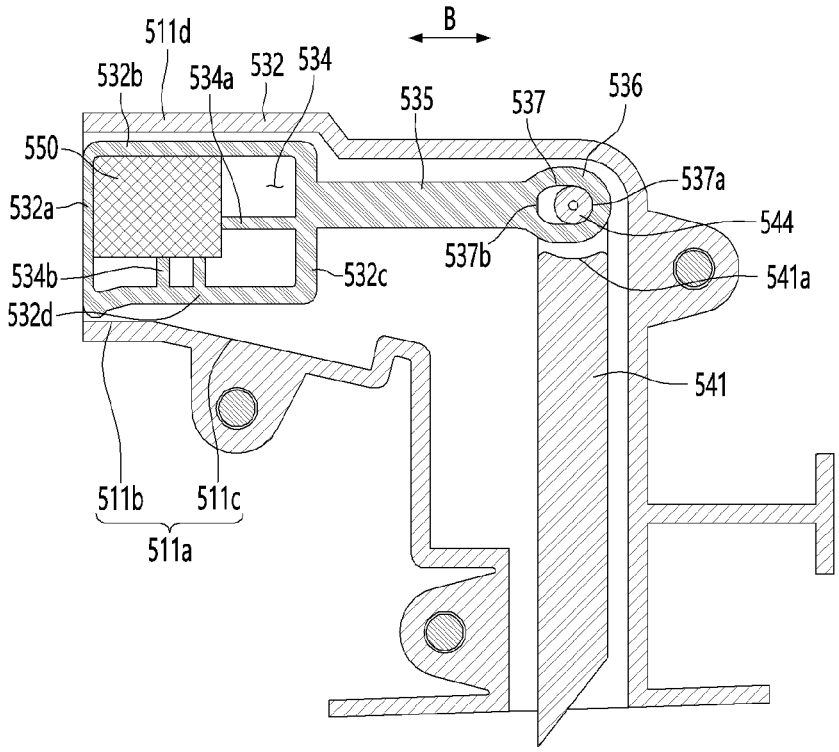
FIG. 11 is a cross-sectional view taken along line 11-11 of FIG. 7.

FIGS. 7 and 8 are perspective views of a locking device according to an embodiment of the present disclosure, FIGS. 9 and 10 are exploded perspective views of a locking device according to an embodiment of the present disclosure, and FIG. 11 is a cross-sectional view taken along line 11-11.

Referring to FIGS. 7 to 11, the locking device 50 of the present embodiment may include a housing 510. The housing 510 may be installed at the inner frame 31.

The locking device 50 may further include a movable unit 530 accommodated in the housing 510 and moved by interacting with the magnetic member 120.

The movable unit 530 may include a plurality of members, one member may be operated by the presence or absence of magnetic force with the magnetic member 120, the other member may be selectively coupled to the second door 40.

For example, the movable unit 530 may include a movable member 531 and a locking member 541.

The locking member 541 may be directly connected to the movable member 531 or may be connected to the movable member 531 by a separate intermediate member. For example, the locking member 541 and the movable member 531 may be connected to rotate relative to each other.

The locking member 541 may move in the up-down direction, and the movable member 531 may rotate.

The housing 510 may include a first opening 517 through which the locking member 541 passes.

In addition, the housing 510 may further include a second opening 518 through which the movable member 531 is exposed. The second opening 518 may be located lower than the first opening 517. With the first door 30 closed, the second opening 518 may be located closer to the front surface 10*a* of the cabinet 10 or the magnetic member 120 than the first opening 517.

The second opening 518 may be disposed to face the magnetic member 120 when the first door 30 is closed.

When the movable member 531 is located in the second opening 518, a distance to the magnetic member 120 is reduced, so that the influence of magnetic force of the magnetic member 120 may be maximized.

In other words, as the thickness of the housing 510 decreases, the distance between the movable member 531 and the magnetic member 120 may decrease.

The first opening 517 may be aligned with the through hole 312 of the inner frame 31.

With the first opening 517 aligned with the through hole 312, the housing 510 is located around the through hole 312 to prevent the foaming liquid from flowing into the through hole 312.

The housing 510 may include a first housing 511 rotatably supporting the movable member 531. The second opening 518 may be provided at the first housing 511.

The housing 510 may further include a second housing 512 that accommodates the movable member 531 and has a smaller horizontal width (width in the direction of arrow A in FIG. 7) than the first housing 511.

The second housing 512 may extend from the first housing 511.

The housing 510 may further include a third housing 513 extending from the second housing 512 and accommodating the locking member 541.

A horizontal width of the third housing 513 may be larger than the horizontal width of the second housing 512.

The movable member 531 may include a rotary shaft 533, and the first housing 511 may include a rotary shaft coupling part 522 to which the rotary shaft 533 is coupled. The rotary shaft coupling part 522 may be a hole or a recess in which the rotary shaft 533 is accommodated.

The rotary shaft coupling part 522 may be located close to the second opening 518. The rotary shaft coupling part 522 may be located in proximity to a bottom wall 511*a* in the first housing 511.

Accordingly, the rotary shaft 533 of the movable member 531 may be located at the lowermost side of the movable member 531.

According to such an arrangement of the rotary shaft 533, the movable member 531 may be located as close as possible to the magnetic member 120 in the first state of the locking device 50, and the movable member 531 may be prevented from protruding outward of the second opening 518. That is, in the unlocking position, the movable member 531 may be prevented from interfering with the outer frame 36. The unlocking position refers to a position of the movable member 531 when the first door 30 is closed.

The rotary shaft 533 is located at a first end of the movable member 531, and the locking member 541 may be connected to a second end located opposite to the first end in the longitudinal direction of the movable member 531.

The longitudinal direction of the movable member 531 is a front-rear direction or a thickness direction of the first door 30 (see B direction in FIG. 11).

When the movable member 531 is rotated around the rotary shaft 533, a vertical movement distance of the locking member 541 per unit rotation angle is advantageously increased.

Accordingly, even if the length of the movable member 531 is reduced, the vertical movement distance of the locking member 541 may be secured, and thus the size of the locking device 50 may be reduced.

When the size of the locking device 50 is reduced, the weight of the locking device 50 may be reduced, and accordingly, the weight of the first door 30 in which the locking device 50 is installed may also be reduced.

An upper wall 511*d* of the first housing 511 may be maintained horizontally, and a part of the bottom wall 511*a* may be inclined downward.

The bottom wall 511*a* of the first housing 511 may include a first bottom wall 511*b* located below the rotary shaft 533 and a second bottom wall 511*c* extending downwardly inclined from the first bottom wall 511*b*. The first bottom wall 511*b* may be a substantially horizontal surface. Alternatively, the bottom wall 511*a* of the first housing 511 may be entirely inclined.

The rotary shaft coupling part 522 may be located above the first bottom wall 511*b*. Accordingly, while the movable member 531 is rotated, a lower surface 532*d* of the movable member 531 may be prevented from interfering with the second bottom wall 511*c*.

The movable member 531 may include a movable body 532, an extending part 535 extending from the movable body 532, and a first connection part 536 extending from the extending part 535.

The extending part 535 may extend in a direction away from the magnetic member 120 from the movable body 532.

The movable body 532 may be formed in a rectangular parallelepiped shape, for example. The rotary shaft 533 may be provided on the movable body 532. For example, the rotary shaft 533 may be located at a front end of the lower surface 532*d* of the movable body 532.

The movable body 532 may be formed of a metal material, for example. In this case, the movable body 532 may act with the magnetic member 120.

For example, in the process of closing the first door 30, a first surface 532*a* of the movable body 532 may rotate in a direction toward the magnetic member 120 by attraction between the movable body 532 and the magnetic member 120.

In this case, the first surface 532*a* is a surface facing the magnetic member 120 with the first door 30 closed.

Meanwhile, in the process of closing the first door 30, the attraction between the movable body 532 and the magnetic member 120 is removed, so that the first surface 532*a* of the movable body 532 may rotate in a direction away from the magnetic member 120.

As another example, the movable body 532 may be injection-molded, for example, and may further include a core body 550 with which the magnetic member 120 interacts.

The core body 550 may be a magnet having a pole different from that of the magnetic member 120 or a metal with which the magnetic member 120 interacts.

One surface of the movable body 532 may be opened to form an accommodation space 534 in the movable body 532. For example, one of both side surfaces of the movable body 532 may be opened.

The core body 550 may be located between the first end and the second end of the movable member 531.

The core body 550 may be in contact with the first surface 532*a* at the movable body 532 so that the attraction between the magnetic member 120 and the core body 550 increases while the first door 30 is closed.

During the process of opening the first door 30, the movable member 531 may be rotated by the weight of the movable member 531 (referred to as forward rotation). Meanwhile, in the process of closing the first door 30, the movable member 531 is rotated by attraction with the magnetic member 120 (referred to as reverse rotation).

If the size of the core body 550 is large, the weight of the entire movable member 531 is heavy, so that the forward rotation of the movable member 531 is smooth, while the reverse direction of the movable member 531 may not be smooth or reverse rotation may not be possible.

Accordingly, the core body 550 may be formed to have a size smaller than that of the accommodation space 534 so that the movable member 531 may be smoothly rotated in the forward and reverse directions.

For example, the core body 550 may be in contact with the first surface 532*a* of the movable member 531 and may be spaced apart from the second surface 532*c* facing the first surface 532*a*.

A front-rear horizontal length (length in the direction of arrow B) of the core body 550 may be longer than ½ of the distance between the first surface 532*a* and the second surface 532*c*.

The movable member 531 may further include a lower surface 532*d* connecting lower sides of the first surface 532*a* and the second surface 532*c* and an upper surface 532*b* connecting upper sides thereof.

In a state where the core body 550 is accommodated in the movable member 531, the core body 550 may be located close to the upper surface 532*b* than to the lower surface 532*d* of the movable member so that the movable member 531 rotates smoothly in the forward direction.

That is, as a distance between the core body 550 and the rotary shaft 533 increases, moment increases, so that the forward rotation of the movable member 531 may be smooth.

For example, the core body 550 may be in contact with the upper surface 532*b* of the movable member 531 and may be spaced apart from the lower surface 532*d*.

One or more support ribs 534*b* extending upwardly to support the core body 550 may be provided on the lower surface 532*d* so that the core body 550 is kept spaced apart from the lower surface 532*b* of the movable member 531.

In addition, a contact rib 534*a* in contact with the core body 550 may protrude from the second surface 532*c* so that the core body 550 remains in contact with the first surface 532*a*.

For example, the contact rib 534*a* may extend in a horizontal direction from the second surface 532*c* toward the first surface 532*a*. The contact rib 534*a* may be spaced apart from the upper surface 532*b* and the lower surface 532*d*.

The extending part 535 may extend from the second surface 532*a* of the movable body 532. Vertical and horizontal widths of the extending part 535 may be smaller than vertical and horizontal widths of the movable body 531. Vertical and horizontal width of the extending part 535 may be smaller than the vertical and horizontal widths of the core body 550.

The extending part 535 may be located in the second housing 512.

In addition, the extending part 535 may extend from a position higher than the rotary shaft 533. The extending part 535 may be located closer to the upper surface 523*b* than the lower surface 532*d* of the movable body 532.

The first connection part 536 may extend from an end of the extending part 535. The locking member 541 may be rotatably connected to the first connection part 536.

The locking member 541 may be located at the third housing 513. In order to connect the locking member 541 to the connection part 536, the first connection part 536 may also be located at the third housing 513.

The first connection part 536 may include a coupling slot 537 for the coupling protrusion 544 of the locking member 541 to be coupled thereto. The coupling slot 537 may be elongated in the longitudinal direction (or front-rear direction) (see arrow B in FIG. 11) of the movable member 531.

The coupling slot 537 may include a second end 537*b* located close to the extending part 535 and a first end 537*a* located opposite to the second end 537*b*.

A distance between the first end 537*a* and the second end 537*b* in the coupling slot 537 is greater than a height of the coupling slot 537.

The coupling protrusion 544 may be varied in position between the first end 537*a* and the second end 537*b* in a state of being accommodated in the coupling slot 537.

Meanwhile, a horizontal width of the locking member 541 in the left-right direction may be greater than a horizontal width (width in the direction of arrow A) of the extending part 535 and the first connection part 536.

The locking member 541 may include a second connection part 543 to be connected to the first connection part 536.

The second connection part 543 may protrude upward from the upper surface 541*a* of the locking member 541.

A horizontal width of the second connection part 536 may be smaller than a horizontal width of the locking member 541 in order to prevent the first connection part 543 and the second connection part 536 from protruding outward in the left-right direction of the locking member 541 in a state where the first connection part 536 is coupled to the second connection part 543.

Although not limited, the horizontal width of the second connection part 543 may be approximately half of the horizontal width of the locking member 541.

The second connection part 543 may be located close to a left end or a right end of the upper surface 541*a* of the locking member 541.

The coupling protrusion 544 may be provided on the second connection part 543. The coupling protrusion 544 may extend in a horizontal direction from the second connection part 543.

In addition, the coupling protrusion 544 may protrude from the second connection part 543 in the left-right direction of the locking member 541.

The coupling protrusion 544 may be located above the upper surface 541*a* of the locking member 541 and spaced apart from the upper surface 541*a*.

The coupling protrusion 544 may be accommodated in the coupling slot 537 of the first connection part 536 in an extending direction of the coupling protrusion 544 from the side of the second connection part 543.

The first connection part 536 may be located to be upwardly spaced apart from the upper surface 541*a* of the locking member 541 so that the first connection part 536 and the upper surface 541*a* of the locking member 541 do not interfere with each other during rotation of the movable member 531 In a state where the first connection part 536 and the second coupling part 543 are connected. In addition, at least a portion of the upper surface of the locking member 541 may be rounded.

Since the horizontal width of the third housing 513 is formed larger than the horizontal width of the second housing 512, the third housing 513 may include guide parts 513*a* and 513*b* guiding vertical movement of the locking member 541 due to a difference in width of the third housing 513 and the second housing 512.

The guide parts 513*a* and 513*b* are recesses accommodating a part of the locking member 541 and may extend in the up-down direction.

The third housing 513 may further include a guide protrusion 529 for guiding vertical movement of the locking member 541.

The guide protrusion 529 may protrude in a horizontal direction from the guide parts 513*a* and 513*b*.

That is, the guide protrusion 529 may be located on a vertical movement path of the locking member 541.

Accommodating recesses 546 and 547 in which the guide protrusion 529 is accommodated may be provided on the side of the locking member 541 in order to guide vertical movement by the guide protrusion 529 without interference with the guide protrusion 529.

The accommodating recesses 546 and 547 may be elongated in the longitudinal direction (in the up-down direction) of the locking member 541.

An inclined surface 542 may be provided at a lower portion of the locking member 541. In case where the locking member 541 is in a lowered state with the second door 40 opened, the inclined surface 542 may serve to prevent damage to the locking member 541 when the second door 40 is closed.

For example, while the locking member 541 is lowered, the inclined surface 542 may be disposed to face the opened second door 40. In this state, when the second door 40 is closed, the second door 40 comes into contact with the inclined surface 542 to press the inclined surface 542, and accordingly, the locking member 541 rises.

It is possible to close the second door 40 without damaging the locking member 541 due to the rising of the locking member 541.

Meanwhile, the housing 510 may be formed by a combination of two half housings, for example.

For example, the housing 510 may be formed by coupling a first half housing 520 and a second half housing 521.

The first half housing 520 may form a part of the first housing 511, the second housing 512, and the third housing 513, and the second half housing 521 may form another part of the first housing 511, the second housing 512, and the third housing 513.

The first half housing 520 and the second half housing 521 may be fastened by one or more screws S1, S2, and S3.

The first half housing 520 may include a first coupling part 525, and the second half housing 521 may include a second coupling part 526.

In a state where the first half housing 520 and the second half housing 521 are in contact with each other, the screws S1, S2, S3 may be fastened to the first coupling part 525 and the second coupling part 526.

In addition, one of the first half housing 520 and the second half housing 521 may have a housing coupling protrusion 523, and the other may have a protrusion accommodating recess 524 in which the housing coupling protrusion 523 is accommodated.

The first half housing 520 may include an edge rib 527 and the second half housing 521 may include an edge recess 528 in which the edge rib 527 is to be located, so that a gap between the first half housing 520 and the second half housing 521 is reduced in a state where the first half housing 520 and the second half housing 521 are in contact with each other.

The edge rib 527 is formed along the edge of the first half housing 520, and the edge recess 528 is formed along the edge of the second half housing 521.

Therefore, when the edge rib 527 is located and in contact with the edge recess 528, the first half housing 520 and the second half housing 521 overlap in the thickness direction, so that a gap between the housing 520 and the second half housing 521 is minimized.

In this way, when the gap between the first half housing 520 and the second half housing 521 is minimized, the foaming liquid may be prevented from flowing into the housing 510.

Each of the first and second half housings 520 and 521 may include a boss accommodating part 515 for accommodating the coupling bosses 313 and 314, respectively.

The boss accommodating part 515 may include a first wall 515*a*, a second wall 515*b* and a third wall 515*c* respectively extending from front and rear ends of the first wall 515*a*, and a fourth wall 515*d* connecting upper ends of the second wall 515*b* and the third wall 515*c*.

The second wall 515*b* and the third wall 515*c* are spaced apart from each other in the direction of arrow B in FIG. 8, and the coupling bosses 313 and 314 may be located between the second wall 515*b* and the third wall 515*c*.

The fourth wall 515*d* may be located at an upper side of the coupling bosses 313 and 314, and a fastening hole 516 through which a fastening member may pass may be formed at the fourth wall 515*d*.

Accordingly, after the fastening member passes through the fastening hole 516 at the upper portion of the fourth wall 515*d*, it may be coupled to the coupling bosses 313 and 314.

The housing 510 may further include a seating wall 514 for seating on the upper surface portion 311 of the inner frame 31.

The seating wall 514 may be provided on each of the half housings 520 and 521. For example, the seating wall 514 may extend from the boss accommodating part 515 toward the front and the rear, respectively.

Therefore, a contact area between the housing 510 and the inner frame 31 is increased by the seating wall 514, so that the housing 510 is stably supported, and the foaming liquid is prevented from flowing toward the first opening 517 and the through hole 312 by the seating wall 514.

The housing 510 may further include a second fixing part 519 to be fixed to the first fixing part 317.

The second fixing part 519 may extend from the third housing 513, for example. The second fixing part 519 may extend in a direction away from the second opening 518 from the third housing 513.

The first half housing 520 forms a part of the second fixing part 519, and the second half housing 521 forms another part of the second fixing part 519.

The second fixing part 519 may include a horizontal extending part 519*a* extending in a horizontal direction from the third housing 513 and a vertical extending part 519*b* extending in a vertical direction from an end of the horizontal extending part 519*a*.

The vertical extending part 519*b* may extend upward and downward from an end of the horizontal extending part 519*a*. That is, the horizontal extending part 519*a* may be located at a position spaced apart from both ends of the vertical extending part 519*b*.

A horizontal width of the horizontal extending part 519*a* may be shorter than a horizontal width of the vertical extending part 519*b*.

Therefore, while the housing 510 is seated on the inner frame 31, the vertical extending part 519*b* may be located between the first portion 317*a* of the first fixing part 317 and the horizontal extending portion 519*a* may be located between the second portion 317*b* of the first fixing part 317.

The pressing rib 318 may press the vertical extending part 519*b*.

Figure 12:
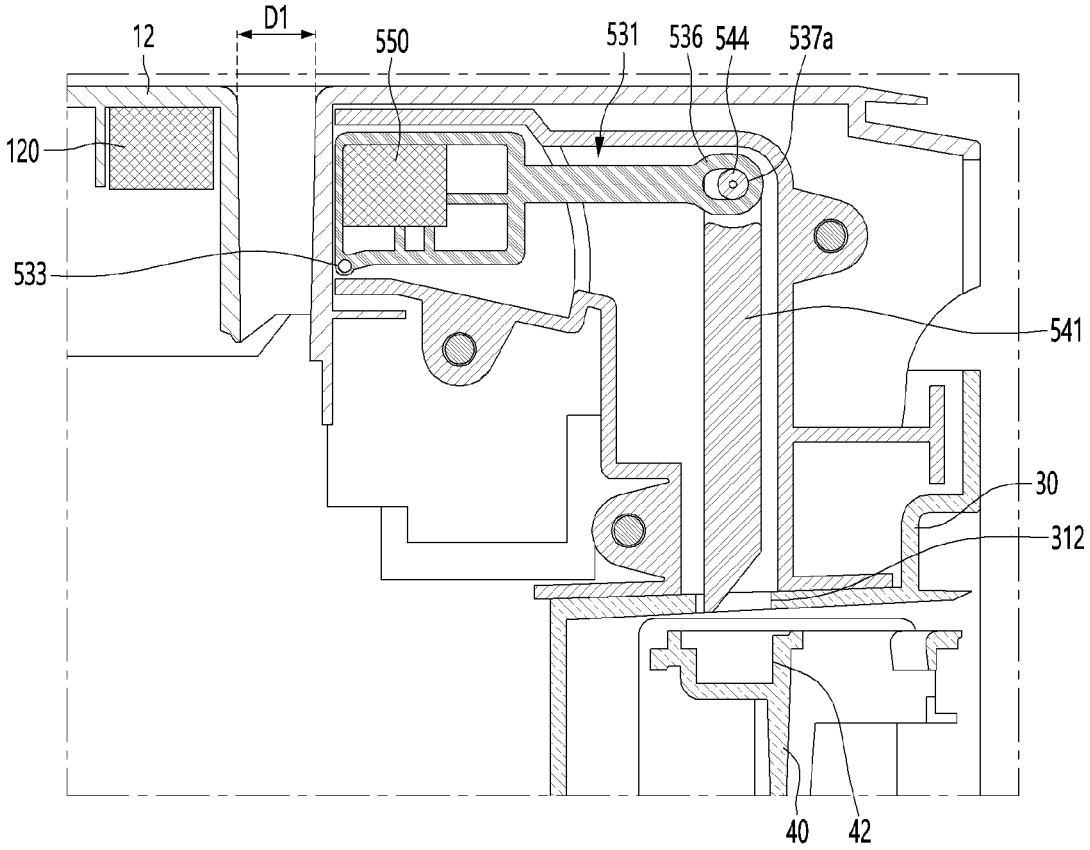
FIG. 12 is a view showing an unlocked state of a first door and a second door by a locking device in a state where the first door is closed.
Figure 13:
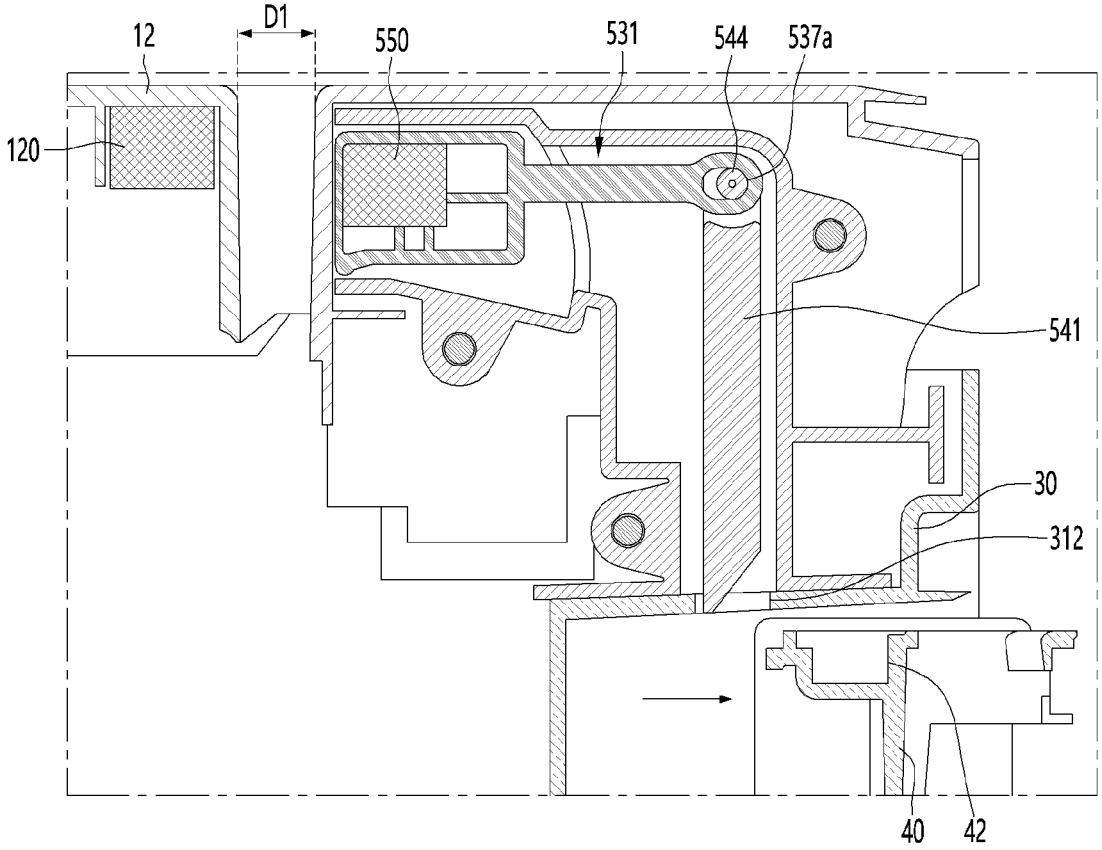
FIG. 13 is a view showing a state where a second door is rotated while the first door is closed.
Figure 14:
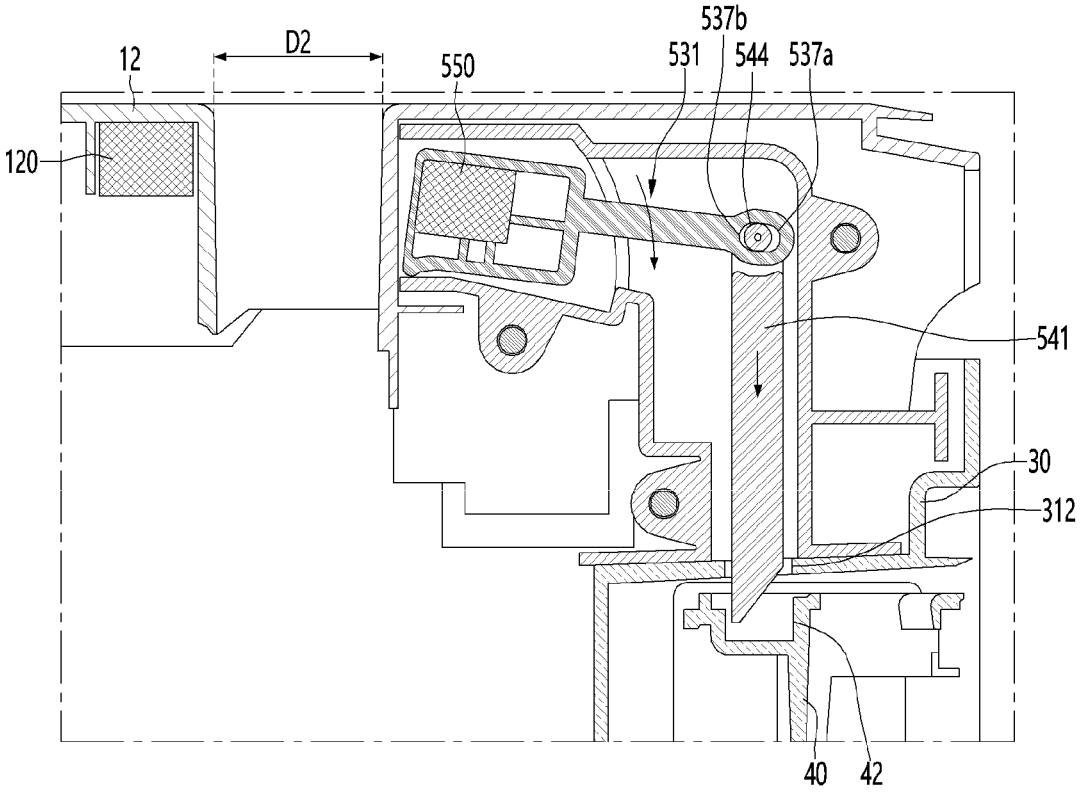
FIG. 14 is a view showing a locked state of a first door and a second door by a locking device in a state where the first door is opened.

FIG. 12 is a view showing an unlocked state of a first door and a second door by a locking device when the first door is closed, FIG. 13 is a view showing a state where the second door is rotated with the first door closed, and FIG. 14 is a view showing a locked state of the first door and the second door by the locking device with the first door opened.

Referring to FIGS. 7 to 14, first, with the first door 30 closed, the movable member 531 may be substantially horizontal.

For example, the first surface 532*a* of the movable member 531 may be disposed in a substantially vertical state, at least a part of the core body 550 may be disposed to face the magnetic member 120 and may be located at substantially the same height as the magnetic member 120.

When the first door 30 is closed, a lower end of the locking member 541 is released from the locking recess 42 of the second door 40.

In addition, a lower end of the locking member 541 may be located in the through hole 312 of the inner frame 31 or higher than the through hole 312.

When the first door 30 is closed, the movable member 531 may maintain a horizontal state due to magnetic force with the magnetic member 120.

Attraction between the magnetic member 120 and the core body 550 is greater than the sum of the load of the movable member 531 and the load of the locking member 541. Accordingly, when the first door 30 is closed, the locking member 541 may be prevented from falling due to its own weight.

When the first door 30 is closed, the coupling protrusion 544 of the locking member 541 may be located closer to the first end 537*a* than the second end 537*b* in the coupling slot 537.

In addition, when the first door 30 is closed, the first connection part 536 may be located higher than the rotary shaft 533.

When the first door 30 is closed, the hinge cover 12 and the first door 30 are spaced apart from each other by a first distance D1 due to the gasket 30*b*.

As described above, when the first door 30 is closed, the lower end of the locking member 541 is released from the locking recess 42, so that the second door 40 may be opened as shown in FIG. 13.

Meanwhile, in the process of opening the first door 30, the first door 30 moves away from the hinge cover 12. Here, when the distance between the hinge cover 12 and the first door 30 is greater than or equal to a second distance D2, attraction between the magnetic member 120 and the core body 550 is removed.

Then, by the load of the locking member 541 and the load of the movable member 531, the movable member 531 may rotate in a forward direction (clockwise in FIG. 14) around the rotary shaft 533.

When the movable member 531 rotates in the forward direction, a height of the first connection part 536 is lowered, and accordingly, the locking member 541 is lowered.

While the locking member 541 is lowered, the coupling protrusion 544 relatively moves in a direction toward the second end portion 537*b* in the coupling slot 537.

The lower end of the locking member 541 is inserted into the locking recess 42 of the second door 40 after passing through the through hole 312 of the inner frame 31 by the lowering of the locking member 541, so that the first door 30 and the second door 40 are in a locked state.

In this way, when the first door 30 and the second door 40 are in a locked state, relative rotation of the second door 40 with respect to the first door 30 may be prevented.

Meanwhile, when the gap between the hinge cover 12 and the first door 30 is less than the second distance D2 in the process of closing the opened first door 30, the movable member 531 may be rotated in a reverse direction (counterclockwise direction) by attraction between the magnetic member 120 and the core body.

Then, the locking member 541 is raised by the reverse rotation of the movable member 531 so that the lower end of the locking member 541 is released from the locking recess 42 of the second door 40, and thus the first door 30 and the second door 40 are in an unlocked state.

The invention claimed is:

1. A refrigerator comprising:
a body having a storage space; and
a door configured to open and close the storage space,
wherein the door comprises:
a first door rotatably connected to the body by a hinge;
a second door provided to be rotatable with respect to the first door;
a magnetic member provided at the body; and
a locking device provided at the first door and configured to interact with the magnetic member,
wherein the locking device comprises:
a housing;
a movable member installed to be rotatable by a rotary shaft and configured to rotate in a first direction by an attraction with the magnetic member and to rotate in a second direction when the attraction with the magnetic member is removed; and
a locking member rotatably connected to the movable member and configured to be accommodated in a locking recess of the second door through the first door when the movable member rotates in the second direction.

2. The refrigerator of claim 1, wherein
the rotary shaft is located adjacent to a first end portion of the movable member, and
wherein the locking member is connected to a second end portion that is located opposite to the first end portion in a longitudinal direction of the movable member.

3. The refrigerator of claim 2, wherein
the movable member is formed of a metal material interacting with the magnetic member.

4. The refrigerator of claim 2, wherein
the movable member comprises a core body configured to interact with the magnetic member, and
wherein the core body is located higher than the rotary shaft.

5. The refrigerator of claim 4, wherein
the movable member comprises a first surface disposed to face the magnetic member in a state where the first door is closed and a second surface which is the opposite to the first surface, and
wherein the core body is located closer to the first surface than to the second surface.

6. The refrigerator of claim 5, wherein
the core body is in contact with the first surface and spaced apart from the second surface.

7. The refrigerator of claim 5, wherein
the movable member comprises a lower surface connecting lower portions of the first surface and the second surface and an upper surface connecting upper portions of the first surface and the second surface, and
wherein the core body is located closer to the upper surface than to the lower surface of the movable member.

8. The refrigerator of claim 7, wherein
the core body is in contact with the upper surface and spaced apart from the lower surface, and
wherein the movable member comprises a support lib configured to support the core body spaced apart from the lower surface.

9. The refrigerator of claim 1, wherein
the housing comprises:
a first bottom wall located below the rotary shaft; and
a second bottom wall extending to be downwardly inclined from the first bottom wall.

10. The refrigerator of claim 1, wherein
the movable member comprises:
a movable body having the rotary shaft;
an extending part extending from the movable body in a direction away from the magnetic member; and
a first connection part extending from the extending part and connected to the locking member,
wherein the locking member comprises a second connection part connected to the first connection part.

11. The refrigerator of claim 10, wherein
vertical and horizontal widths of the extending part are smaller than vertical and horizontal widths of the movable body, and
wherein the extending part extends from a position higher than the rotary shaft.

12. The refrigerator of claim 10, wherein
the first connection part comprises a coupling slot,
wherein the second connection part comprises a coupling protrusion accommodated in the coupling slot, and
wherein the coupling slot elongates in a longitudinal direction of the movable member.

13. The refrigerator of claim 10, wherein
the second connection part protrudes upward from an upper surface of the locking member and is smaller than a horizontal width of the locking member, and
wherein the first connection part is connected to the second connection part on a side of the second connection part.

14. The refrigerator of claim 13, wherein
the first connection part is spaced apart from the upper surface of the locking member in a state where the first connection part is connected to the second connection part.

15. The refrigerator of claim 1, wherein
the first door comprises an inner frame forming an opening and the second door covers the opening,
wherein the housing is fixed to the inner frame and comprises a first opening allowing the locking member to pass therethrough, and
wherein the inner frame has a through hole aligned with the first opening.

16. The refrigerator of claim 15, wherein
the housing is seated in the inner frame and disposed to surround the through hole.

17. The refrigerator of claim 15, wherein
the inner frame comprises a coupling boss,
wherein the housing comprises a boss accommodation part configured to accommodate the coupling boss, and
wherein a screw is fastened to the coupling boss through a portion of the boss accommodation part in a state where the coupling boss is accommodated in the boss accommodation part.

18. The refrigerator of claim 15, wherein
the inner frame comprises a plurality of coupling bosses to be fastened to the housing, and
the through hole is located between the plurality of coupling bosses, and
wherein a portion of the housing is located between the plurality of coupling bosses.

19. The refrigerator of claim 15, wherein
the inner frame further comprises an edge portion,
wherein the edge portion has a first fixing part, and
wherein the housing comprises a second fixing part fixed to the first fixing part when the housing is seated in the inner frame.

20. The refrigerator of claim 15, wherein
the housing further comprises a second opening exposing the movable member to outside of the housing, and
wherein the second opening is disposed to face the magnetic member in a state where the first door is closed.

* * * * *